US008430546B2

(12) United States Patent
Zhou et al.

(10) Patent No.: US 8,430,546 B2
(45) Date of Patent: Apr. 30, 2013

(54) DUSTPROOF LENS AND ITS MODULE FOR LED ROAD LAMP

(75) Inventors: Shikang Zhou, Shanghai (CN); Xin Cheng, Shanghai (CN); Mengsheng Wang, Shanghai (CN); Yuexia Chen, Shanghai (CN)

(73) Assignees: Shanghai Sansi Electronics Engineering Co., Ltd., Minhang District, Shanghai (CN); Shanghai Sansi Technology Co., Ltd., Minhang District, Shanghai (CN); Jiashan Sansi Photoelectric Technology Co., Ltd., Jiaxing, Zhejiang Province (CN)

( * ) Notice: Subject to any disclaimer, the term of this patent is extended or adjusted under 35 U.S.C. 154(b) by 0 days.

(21) Appl. No.: 13/339,032

(22) Filed: Dec. 28, 2011

(65) Prior Publication Data

US 2012/0099337 A1 Apr. 26, 2012

(30) Foreign Application Priority Data

Feb. 18, 2011 (CN) ..... 2011 1 0040358

(51) Int. Cl.
*F21V 5/04* (2006.01)

(52) U.S. Cl.
USPC ..... 362/521; 362/520

(58) Field of Classification Search ..... 362/521, 362/520; 359/507
See application file for complete search history.

(56) References Cited

U.S. PATENT DOCUMENTS 7,411,749 B2 * 8/2008 Liu ..... 359/819

* cited by examiner

*Primary Examiner* — Joseph L Williams

(57) ABSTRACT

A dustproof lens for an LED road lamp has an incident surface and an exit surface. The exit surface is flat. The incident surface is saddle-shaped and has a section in a shape of a concave curve along a road direction and in a shape of a convex curve vertically to the road direction. A lens module thereof has the dustproof lenses jointed with each other and has an integrally flat exit plane. The dustproof lens and its module, while meeting requirements in distributing lights for road lighting, adopt a flat surface for emitting lights, in such a manner that the lens is protected from dusts piled up thereon, can be cleaned simply, and is better fit for using. By accomplishing modularization of the lens module in production and assembly, a productive efficiency of lamps is greatly improved.

13 Claims, 5 Drawing Sheets

DUSTPROOF LENS AND ITS MODULE FOR LED ROAD LAMP

BACKGROUND OF THE PRESENT INVENTION

1. Field of Invention

The present invention relates to an optical component, and more particularly to a dustproof protective lens and its module for an LED road lamp.

2. Description of Related Arts

Conventional lighting lamps are gradually being replaced by energy-conserving and environment-friendly LED lighting lamps. However, by using an LED as a light source, a light redistributing is usually necessary because of the features of the LED itself. Usually the emission side of the LED is covered by an optical lens to meet lighting requirements of practical using. For example, in road lighting, the lighting distance along the road direction is relatively long while the lighting distance at the direction vertical to the road direction is relatively short. Besides, the exit surface of the optical lens adopted by the conventional LED road lamps is usually not flat, which causes that the exit surface tends to have dusts piled up thereon if used for a long time. Therefore, the light producing efficiency is greatly reduced. It is also not easy to modularize the conventional lens.

SUMMARY OF THE PRESENT INVENTION

Thus, according to technical problems existing in the conventional arts, the present invention provides a dustproof lens for an LED road lamp to meet requirements in light intensity distribution of road lighting. Besides, by adopting a flat plane as its exit surface of the lens the dusts are protected from piled up thereon and can be wiped out simply without affecting normal usage of the lens.

The present invention further provides a dustproof lens module having an integrally single flat exit surface, which solves problems of intensity distribution and dustproofness, and modularizes production and assembly, in such a manner that productive efficiency of lamps is greatly improved.

Thus, in order to solve the above technical problems, the present invention adopts following technical solutions.

A dustproof lens for an LED road lamp has an incident surface and an exit surface, characterized in that the exit surface is flat and the incident surface is saddle-shaped whose section along a road direction is provided as a concave curve and the section along the road vertical direction a convex curve.

The incident surface is symmetrical at two sides of a section along the road direction and passing through an optical axis of a light source.

Or the incident surface is asymmetrical at two sides of a section along the road direction and passing through an optical axis of a light source.

The incident surface is symmetrical at two sides of a section vertical to the road direction and passing through the optical axis of the light source.

A non-transmitting surface is provided around laterals of the saddle-shaped incident surface.

The non-transmitting surface has an optional shape and an optional thickness.

The non-transmitting surface is frosted.

The lens is made of a transparent material having a refractive index between 1.3 and 4.2.

A dustproof lens module is characterized in that the module comprises a plurality of the dustproof lenses for LED road lamps to be jointed with each other, wherein each lens corresponds to one LED light source and the joint exit planes forms a single flat surface.

The dustproof lens module has each lens regularly or irregularly spaced, or jointed into a whole piece through the non-transmitting surfaces, at a side of the incident surfaces.

In the technical solutions of the present invention, the exit surface of the lens is flat, in such a manner that the exit plane of the lens is protected from dusts piled up thereon and the dusts can be wiped out simply even if dusts are piled up thereon. The incident surface is saddle-shaped, that is to say that the incident surface is provided as a concave curve along the road direction to produce a relatively large beam angle, and that the incident surface is provided as a convex curve vertically to the road direction to produce a relatively small beam angle, so as to better meet lighting requirements under present road standards. Besides, the saddle-shaped incident surface is asymmetrical at the two sides of the section along the road direction and passing through the optical axis of the light source, in such a manner that the lens tilts the lights vertically to the road direction. By tilting lights, when the lamp is installed at two sides of the road, the road still has a relatively big transverse uniformity of illumination.

The lens is modularized to facilitate the installation and disassembly and improve the productive efficiency.

BRIEF DESCRIPTION OF THE DRAWINGS

Combined with the drawings and preferred embodiments, further detailed description is following.

DETAILED DESCRIPTION OF THE PREFERRED EMBODIMENT

Figure 1:
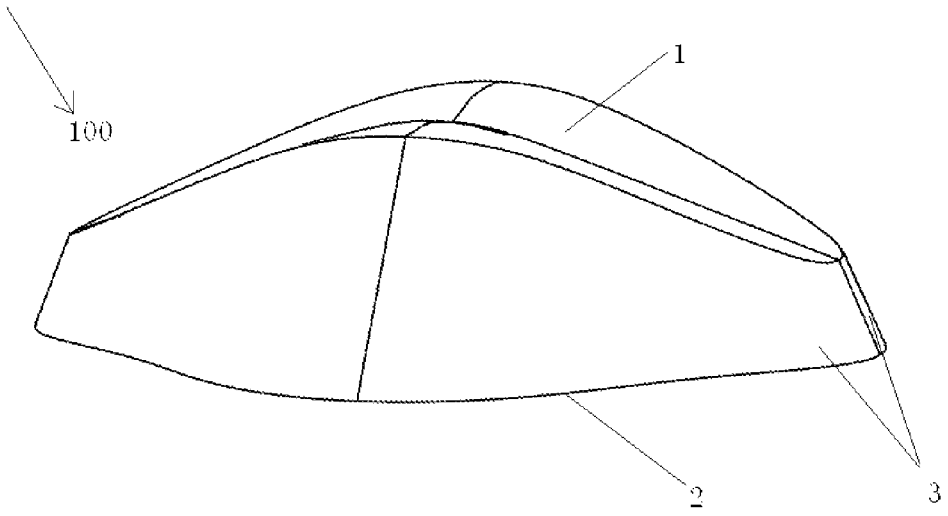
FIG. 1 is a sketch view of a first lens according to a preferred embodiment of the present invention.
Figure 2:
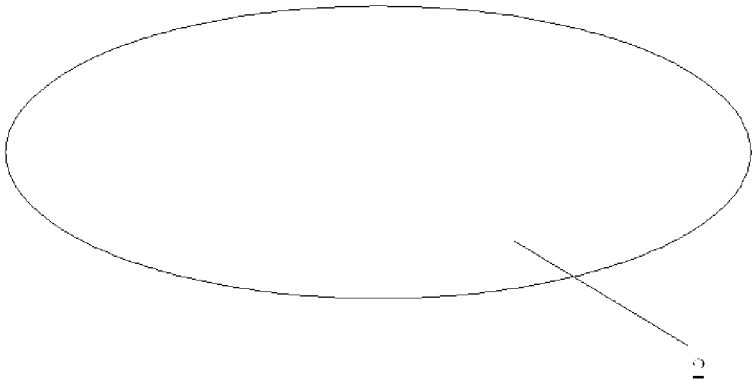
FIG. 2 is a sketch view of an exit plane of the lens in FIG. 1.
Figure 3:
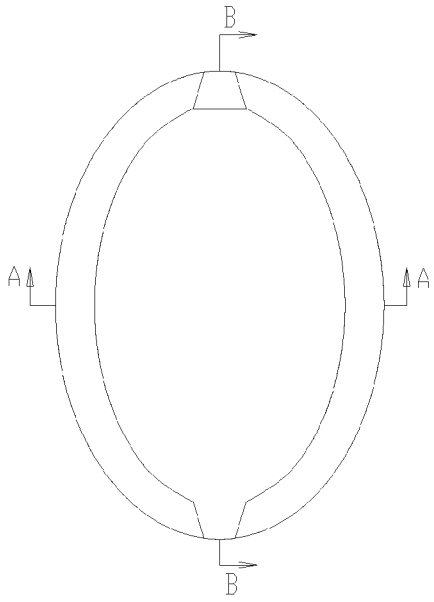
FIG. 3 is a front view of the lens in FIG. 1.
Figure 4:
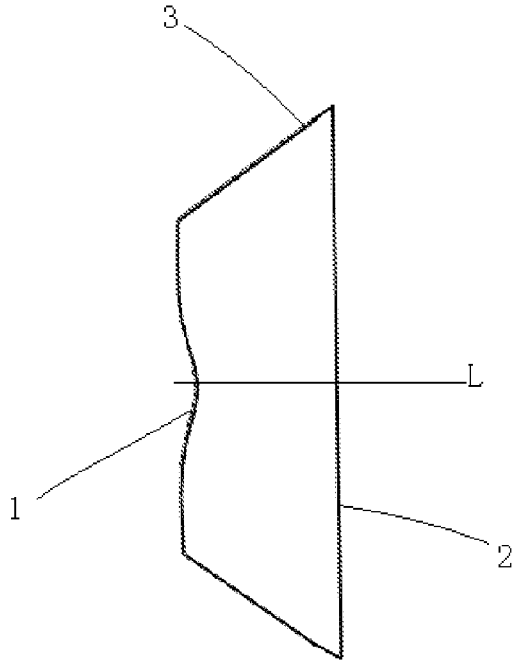
FIG. 4 is a sectional view of an A-A direction in FIG. 3.
Figure 5:
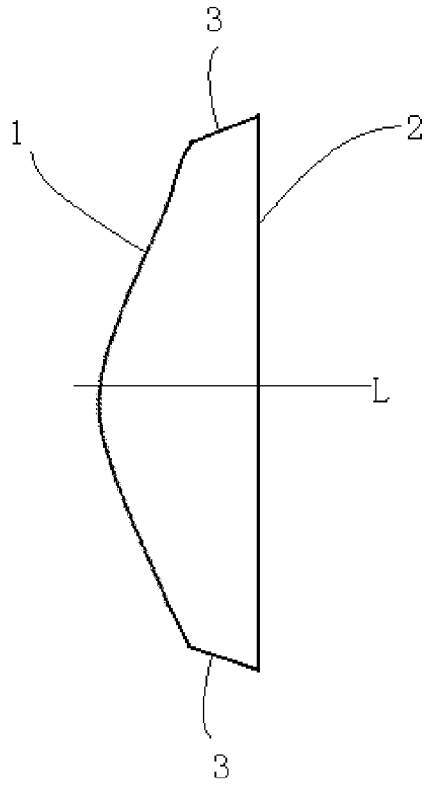
FIG. 5 is a sectional view of a B-B direction in FIG. 3.
Figure 6:
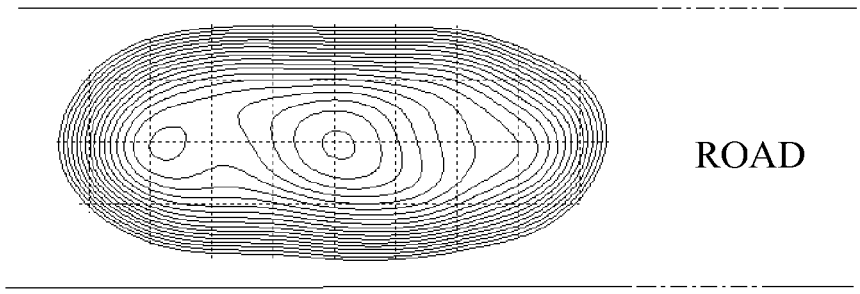
FIG. 6 is a sketch view of an optical spot of FIG. 1.
Figure 7:
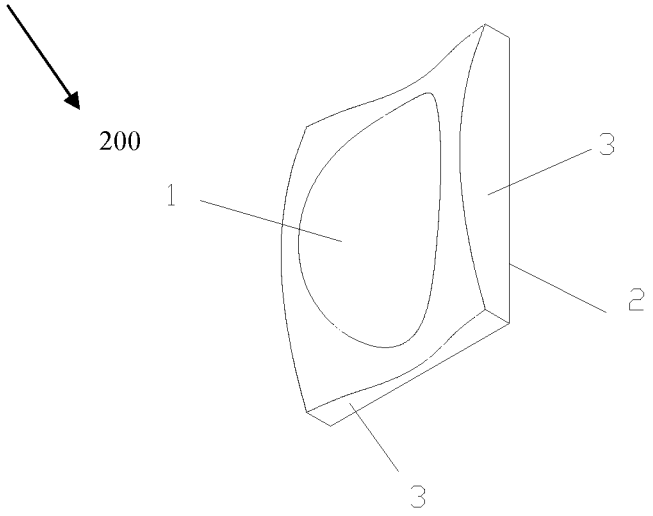
FIG. 7 is a sketch view of a second lens according to a preferred embodiment of the present invention.

Referring to the drawings from FIG. 1 to FIG. 6, according to a first preferred embodiment of the present invention, a first dustproof lens 100 for an LED road lamp is illustrated, wherein an exit plane 2 of the first lens 100 is elliptical as shown in FIG. 2. A incident surface 1 is saddle-shaped. As shown in FIG. 6, a beam spot of the first lens 100 is elliptical. In installing, the major axis of the ellipse of the first lens 100 is vertical to a road direction and the minor axis thereof is along the road direction. FIG. 4 shows a first section of FIG. 3 at an A-A direction, wherein the saddle-shaped plane of incident surface 1 is a concave curve along the road direction; FIG. 5 shows a second section of FIG. 3 at a B-B direction, wherein the saddle-shaped of incident surface 1 is provided as a convex curve vertically to the road direction. The incident surface 1 is symmetrical at two sides of a section vertical to the road direction and passing through an optical axis L of a light source, and is symmetrical at two sides of a section along the road direction and passing through the optical axis L of the light source. A non-transmitting surface 3 is provided around outer laterals of the saddle-shaped plane of incidence 1, wherein a shape and a thickness of the non-transmitting surface 3 are optional based on some requirements, such as easy installation, strength and material-saving, in a condition that the plane of incidence 1 maintains to be saddle-shaped and lighting directions stay unchanged. FIG. 7 shows a second lens 200 having the rectangle-shaped non-transmitting surface 3. An outer surface of the non-transmitting surface 3 is frosted to effectively reduce stray lights.

Figure 8:
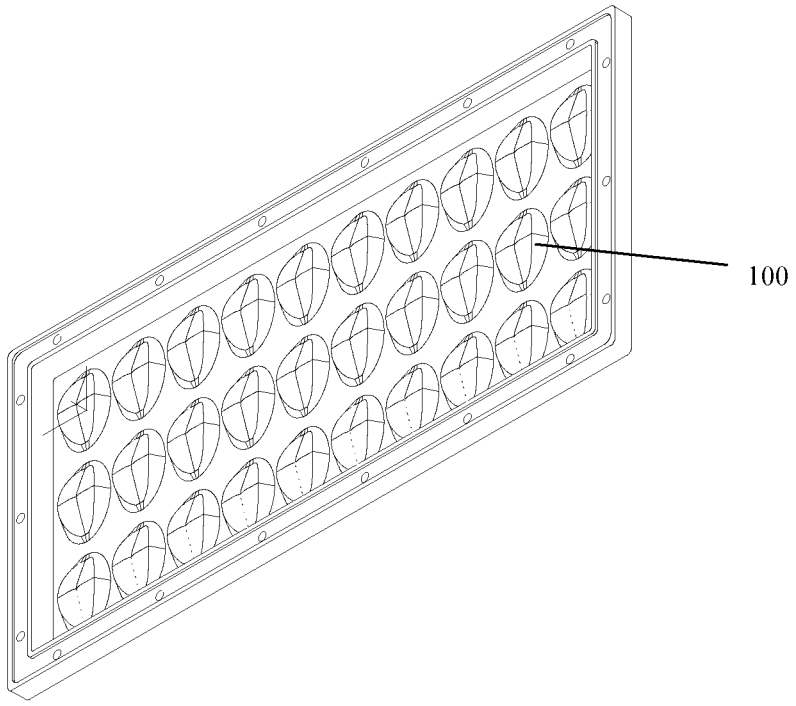
FIG. 8 is a sketch view of a first dustproof lens module having the first lenses of FIG. 1 jointed with each other.
Figure 9:
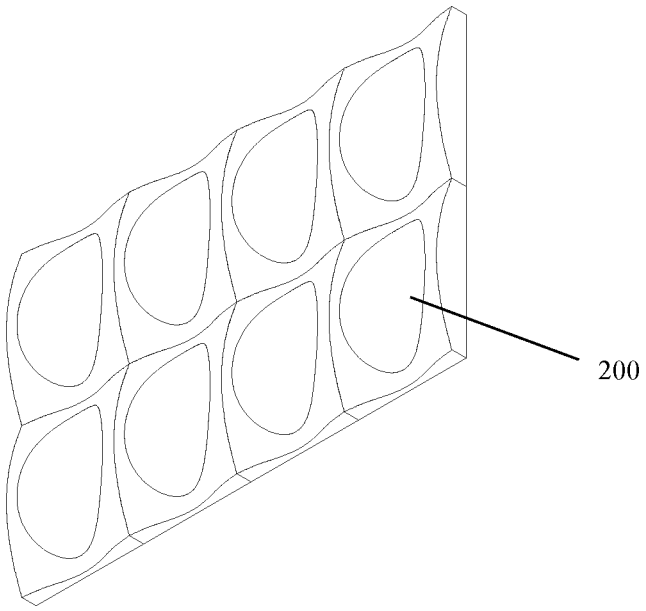
FIG. 9 is a sketch view of a second dustproof lens module having the second lenses of FIG. 7 jointed with each other.
Figure 10:
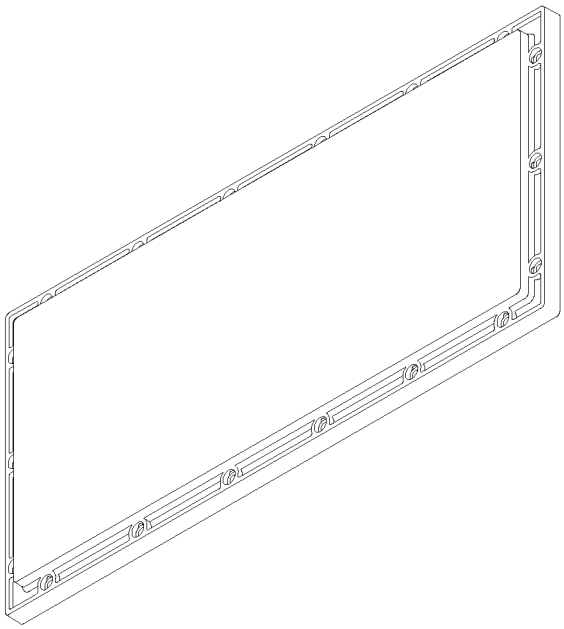
FIG. 10 is a sketch view of an exit plane of the dustproof lens module in FIG. 8 and FIG. 9.

FIG. 8 and FIG. 9 show dustproof lens modules made through jointing. Several first lenses 100 or second lenses 200 are spaced regularly, or spaced irregularly. FIG. 10 shows that the lens module has a flat exit plane. Each lens corresponds to one LED light source at a side of the plane of incidence. FIG. 8 shows a first dustproof lens module having the first lenses 100 jointed with each other, wherein the first lenses 100 are spaced regularly. FIG. 9 shows a second dustproof lens module having the second lenses 200 jointed with each other, wherein the lens module is formed into a whole piece through the rectangular non-transmitting surface 3 at the side of the plane of incidence.

What is claimed is:

1. A dustproof lens for an LED road lamp, having an incident surface and an exit surface, wherein said exit surface is flat; said incident surface is saddle-shaped and has a section in a shape of a concave curve along a road direction and in a shape of a convex curve vertically to the road direction.

2. The dustproof lens, as recited in claim 1, wherein said incident surface of lens section along the road direction and passing through an optical axis of a light source is axisymmetrical.

3. The dustproof lens, as recited in claim 1, wherein said incident surface of lens section along the road direction and passing through an optical axis of a light source is non-axisymmetrical.

4. The dustproof lens, as recited in claim 1, wherein said incident surface of lens section vertical to the road direction and passing through the optical axis of the light source is axisymmetrical.

5. The dustproof lens, as recited in claim 2, wherein said incident surface section vertical to the road direction and passing through the optical axis of the light source is axisymmetrical.

6. The dustproof lens, as recited in claim 3, wherein said incident surface section vertical to the road direction and passing through the optical axis of the light source is axisymmetrical.

7. The dustproof lens, as recited in claim 1, wherein a non-transmitting surface is provided around laterals of said saddle-shaped incident surface.

8. The dustproof lens, as recited in claim 7, wherein said non-transmitting surface has an optional shape and an optional thickness.

9. The dustproof lens, as recited in claim 7, wherein said non-transmitting surface is frosted.

10. The dustproof lens, as recited in claim 8, wherein said non-transmitting surface is frosted.

11. The dustproof lens, as recited in claim 1, wherein said lens is made of a transparent material having a refractive index between 1.3 and 4.2.

12. A dustproof lens module, wherein said module comprises several dustproof lenses recited in claim 1 jointed with each other; each lens corresponds to one LED light source; said jointed exit flat plane form a single flat plane.

13. The dustproof lens module, as recited in claim 12, wherein said dustproof lens module has each lens regularly or irregularly spaced, or has each lens jointed through said non-transmitting surface into a whole piece at a side of said incident surface.

* * * * *